US005738061A

United States Patent [19]

Kawamura

[11] Patent Number: 5,738,061

[45] Date of Patent: Apr. 14, 1998

[54] ENGINE HAVING SOUND ABSORPTION STRUCTURES ON THE OUTER SIDES OF COMBUSTION CHAMBERS

[75] Inventor: Hideo Kawamura, Samukawa-machi, Japan

[73] Assignee: Isuzu Ceramics Research Institute Co., Ltd., Kanagawa-ken, Japan

[21] Appl. No.: 675,071

[22] Filed: Jul. 3, 1996

[30] Foreign Application Priority Data

Jul. 6, 1995 [JP] Japan ..... 7-192649
Jul. 6, 1995 [JP] Japan ..... 7-192650

[51] Int. Cl.[6] ..... F02B 77/11

[52] U.S. Cl. ..... 123/193.1; 123/668

[58] Field of Search ..... 123/193.1, 193.2, 123/193.3, 193.4, 193.5, 193.6, 668, 669

[56] References Cited

U.S. PATENT DOCUMENTS

| | | | |
|---|---|---|---|
| 3,081,754 | 3/1963 | Georges | 123/193.1 |
| 3,996,913 | 12/1976 | Hamparian | 123/668 |
| 4,523,554 | 6/1985 | Ryu | 123/668 |
| 4,524,732 | 6/1985 | Dworak et al. | 123/193.3 |
| 4,715,178 | 12/1987 | Tsukuda et al. | 123/193.5 |
| 4,774,926 | 10/1988 | Adams | 123/668 |
| 4,864,987 | 9/1989 | Kawamura | 123/668 |
| 5,033,427 | 7/1991 | Kawamura et al. | 123/668 |
| 5,063,881 | 11/1991 | Kawamura | 123/668 |
| 5,080,081 | 1/1992 | Kawamura | 123/668 |
| 5,282,411 | 2/1994 | Hirai et al. | 123/193.6 |

FOREIGN PATENT DOCUMENTS

| | | |
|---|---|---|
| 2700120 | 7/1978 | Germany . |
| 59-182650 | 5/1984 | Japan . |
| 59-122765 | 7/1984 | Japan . |

OTHER PUBLICATIONS

Patent Abstracts of Japan, JP62013758, Jan. 22, 1987.

*Primary Examiner*—Marguerite McMahon
*Attorney, Agent, or Firm*—Browdy and Neimark

[57] ABSTRACT

The present invention relates to a sound absorption structure-carrying engine provided on the outer sides of combustion chambers with sound absorption layers adapted to shut off the pressure waves occurring in the combustion chambers. In this engine, combustion chamber members are provided in the cavities in a cylinder head via sound absorption gaskets. The pistons moved reciprocatingly in the cylinders comprise piston heads, piston skirts, and sound absorption gaskets provided between the piston heads and piston skirts. The sound absorption gaskets comprise sound absorption layers formed out of a rubber material, such as synthetic rubber of a high heat conductivity capable of minimizing the transmission of vibration and a metallic material. In a heat insulating structure-carrying engine, heat insulating layers preventing the radiation of heat are provided between the combustion chambers and sound absorption layers. The heat insulating layers comprise ceramic fiber of a low heat conductivity and vacuum layers.

19 Claims, 3 Drawing Sheets

ENGINE HAVING SOUND ABSORPTION STRUCTURES ON THE OUTER SIDES OF COMBUSTION CHAMBERS

BACKGROUND OF THE INVENTION

1. Field of the Invention

This invention relates to an engine having sound absorption structures on the outer sides of combustion chambers.

2. Description of the Prior Art

There is a known cooling type engine in which water jackets are provided in a cylinder head and a cylinder block with ceramic liners fitted in cavities formed in the cylinder head. Each head liner comprises a unitary combination of a head lower portion and a liner upper portion, and this liner upper portion is formed as a member different from a lower cylinder liner. In order to fix the head liners to the cylinder head, the former are fitted in the cavities of the latter by press fitting or shrinkage fitting via a gasket having positioning rings and positioning plates.

In a conventional reciprocating engine, noise occurs due to piston slaps, motions of a cam driving gear in a valve gear, a gear train, an auxiliary driving gear, and pressure waves due to explosion during the combustion of a gaseous mixture in combustion chambers. The level of noise in a diesel engine becomes higher in general than that of noise in a gasoline engine. The explosion pressure waves occurring due to the combustion of a gaseous mixture have distribution in a region of around 100 Hz to tens of thousands of Hz, and the vibration due to the explosion is transmitted to the wall surfaces of the combustion chambers and resonates with an oil pan, an outer surface of an engine body, such as a cylinder block, or a transmission to cause noise to occur.

In order to reduce noise occurring in a reciprocating engine, head liners and piston heads as combustion chamber wall members constituting combustion chambers are separated from an engine body which supports these wall members, and providing intermediate members, which comprise a sound absorption material, on the outer sides of the wall members, whereby very effective sound insulating structures capable of preventing at least the transmission of vibration occurring due to the combustion of a gaseous mixture can be formed. In a reciprocating engine, the vibration of gears, cams and a crankshaft due to the motions thereof in addition to the vibration of pistons due to the reciprocating motions thereof, vibration of valves due to the motions thereof, and combustion vibration cause noise. Especially, in a reciprocating engine, almost all of the sources of noise exist around the pistons which constitute combustion chambers.

Therefore, a cooling type engine has an issue of how to form a sound absorption gasket using a sound absorption material, an issue of how to provide a sound absorption gasket with respect to combustion chambers, and an issue of how to shut off the noise occurring due to pressure waves in the combustion chambers therefrom.

There is a known heat insulating engine in which ceramic head liners comprising a combination of a part of each cylinder and a cylinder head are fitted in the cavities of the cylinder head via a heat insulating layer, such as a heat insulating air layer. The head liners are formed out of a ceramic material to comparatively thick-walled structures.

The heat insulating engine is formed to a structure adapted to minimize an escape of heat therefrom, in which head liners, cylinder liners and piston heads are formed out of a ceramic material with heat insulating air layers provided on the outer sides of these parts. In the heat insulating engine, the combustion chambers have a high-temperature atmosphere, and, unless the heat insulating structures between the combustion chambers and cylinder head are satisfactorily formed, the thermal energy in the combustion chambers is transmitted from the combustion chamber walls to the cylinder head, and discharged to the outside through the cylinder head to cause a thermal efficiency to lower. Such heat insulating engines as described above include, for example, an engine disclosed in Japanese Patent Laid-Open No. 122765/1984.

Japanese Utility Model Laid-Open No. 182650/1984 discloses a sound insulator-carrying heat insulating engine. The sound insulator in this heat insulating engine is constructed by forming pistons, which constitute combustion chambers, and a cylinder head out of a heat resisting and insulating material, forming sound absorption chambers around the cylinder block and cylinder head, and filling the interior of the sound absorption chambers with a sound absorption material.

The heat insulating engine has a heat insulating structure which is effective not only for shutting off a flow of heat but also for shutting off vibration, and, if a sound absorption material is provided around the outer circumferences of the combustion chambers, noise and vibration as well as heat can be shut off at once. In the heat insulating engine, the interior of the combustion chambers has a high-temperature atmosphere, and, unless the heat insulating structure between the combustion chamber walls and cylinder head is satisfactorily formed, the thermal energy in the combustion chambers is transmitted from the combustion chamber walls to the cylinder head, and discharged to the outside through the cylinder head to cause a thermal efficiency to lower.

Therefore, the heat insulating engine should be formed at the portions thereof which face the combustion chambers out of a ceramic material, such as silicon nitride having a high thermal resistance, excellent heat insulating characteristics and a high thermal shook resistance so that the engine can withstands a high-temperature combustion gas, and it has an issue of developing the techniques for preventing the high-temperature heat in the combustion chambers from being discharged to the outside through the cylinder head, and an issue of developing the techniques for shutting off the noise which occurs due to the vibration of pressure waves in the combustion chambers the temperature in which becomes high as compared with that in the combustion chambers in a cooling type engine.

SUMMARY OF THE INVENTION

An object of the present invention is to provide a sound absorption structure-carrying engine having combustion chamber members constituting heat insulating combustion chambers formed by cylinders and piston beads, characterized in that seals, or intermediate members having both the heat insulating function and sound absorption function, or sound absorption gaskets which are formed out of a metal, rubber, a composite material of ceramic fiber and rubber, or a composite material of a metal and rubber are provided between the combustion chamber members and a member, such as an engine body supporting the combustion chamber members, so as to effectively shut off from heat sources and sound sources not only a flow of heat but also the vibration due to explosion pressure waves occurring during the combustion of a gaseous mixture in the combustion chambers, whereby heat transfer and noise-constituting vibration are prevented at once.

The present invention relates to a sound absorption structure-carrying engine comprising a cylinder block in which cylinders are provided, a cylinder head fixed to the cylinder block, pistons moved reciprocating by in the cylinders, combustion chamber-forming combustion chamber members provided in cavities formed in the cylinder head, and intermediate members provided between the inner surfaces of the cavities and the outer surfaces of the combustion chamber members, each of the intermediate members being formed by a heat insulating layer of a low heat conductivity and a sound absorption layer provided on the outer side of the heat insulating layer and capable of minimizing the transmission of vibration, the combustion chambers being formed to heat insulating structures by the respective heat insulating layers.

Each of the combustion chamber members is a head liner formed out of a ceramic material, such as silicon nitride in which a cylinder lower portion and a cylinder upper portion are combined with each other to a unitary structure. The head liners are supported in the cavities in the cylinder head via the intermediate members.

Each of the intermediate members comprises a first plate provided on the outer side of the relative head liner and having a wavy surface, a second plate provided on the outer side of the first plate with a vacuum layer formed therebetween and having a flat surface, ceramic fiber provided between the first and second plates, and a heat resisting sound absorption member provided on the outer side of the second plate so that the outer surface of the second plate is in a non-contacting state with respect to the inner surface of the relative cavity.

Moreover, the contact area between the combustion chamber member and first plate is small, and the first and second plates constitute a heat insulating gasket, this heat insulating gasket and the vacuum layer forming a heat insulating layer, the heat resisting sound absorption member constituting a sound absorption layer. The heat insulating gasket reduces an overall heat transfer coefficient from one surface of the combustion chamber member to the other surface thereof and heat flow from a high-temperature portion to a low-temperature portion, whereby a heat conductivity of the gasket as a whole decreases.

Each of the pistons comprises a piston head formed out of a ceramic material, such as silicon nitride, and a piston skirt fixed to the piston head, and second intermediate members are interposed between the piston head and piston skirt. The second intermediate members comprise a first plate provided on a lower surface of the piston herd and having a wavy surface, a second plate provided on a lower surface of the first plate with a vacuum layer formed therebetween and having a flat surface, and a heat resisting sound absorption member provided between a lower surface of the second plate and an upper surface of the piston skirt.

The cylinders comprise cylinder liners fitted in bores formed in the cylinder block. The cylinder liners comprise cylinder members formed out of silicon nitride containing a metal oxide, such as oil adsorptive $Fe_3O_4$ which constitutes cylinder surfaces, and intermediate members provided on the outer sides of the cylinder members and formed out of a composite reinforced sound absorptive material of a combination of heat resisting rubber and a metallic material, or a sound absorptive material including heat resisting rubber and metal fiber or ceramic fiber.

The valve guides slidably supporting suction-exhaust valves and provided in the cylinder head are formed out of silicon nitride containing a metal oxide, such as oil adsorptive $Fe_3O_4$, and third intermediate members formed out of heat resisting rubber are provided on the outer sides of the valve guides.

Since this sound absorption structure-carrying engine is provided with intermediate members, which comprise a material having a low heat conductivity and capable of minimizing the transmission of vibration, between the combustion chamber members and cylinder head, the radiation of the heat in the combustion chambers from the combustion chamber members to the outside through the cylinder head and piston skirts is prevented by these intermediate members, and the pressure waves occurring in the combustion chambers are shut off by the intermediate member. Namely, the intermediate members fulfil both the function of heat insulating layers and that of sound absorption layers to effectively shut off the vibration and noise due to the explosion pressure waves occurring in the combustion chambers. Moreover, the intermediate members are provided between various kinds of members and can fulfil the adjacent member sealing function.

In this sound absorption structure-carrying engine, the combustion chamber-forming walls and the members supporting these walls are formed separately, and heat insulating air layers and intermediate members are interposed between the walls and wall support members. The structures, in which intermediate members and sound absorption members are combined, function effectively for shutting off not only a flow of heat but also noise and vibration.

Since the vibration occurring in a sound absorption structure-carrying engine is transmitted molecularly, the transmission of the vibration can be prevented by interposing a laminated structure, in which a solid layer alternates with a gas layer, between object parts, or making vacuous a region between object parts by removing an object therefrom. When a vibrating body is formed out of a soft material, for example, rubber, i.e. synthetic rubber, the vibrating particles therein interfere with one another to suppress the propagation of vibratory waves, so that the vibrating body displays a sound absorption effect.

In a heat insulating engine, a cooling system including water jackets, water pumps and fans is not provided on the cylinder head and cylinder block, and, therefore, the vibration from the combustion chambers is transmitted directly to the outer wall. Accordingly, if a noise insulation structure combined with a heat insulating structure is employed in the heat insulating engine, a very effective low noise engine is completed. The present invention is directed to a heat insulating engine employing a structure formed by combining a heat insulating structure and a noise insulation structure with each other. Since the temperature of the ceramic combustion chamber wall surfaces is high due to the heat insulating characteristics thereof, the combustion chambers require to hove a rigidity. Therefore, the combustion chambers are formed to structures employing a material having a heat resistance, a rigidity and a large sound absorbing power.

Another object of the present invention is to provide an engine having sound absorption structures on the outer sides of combustion chambers, comprising cooling means provided on a cylinder head and a cylinder block, combustion chamber members provided in cavities in the cylinder head and forming combustion chambers therein, and sound absorption gaskets which are provided between the combustion chamber members and the cavities in the cylinder head so as to effectively shut off from sound sources the vibration due to explosion pressure waves occurring during the combustion of a gaseous mixture in the combustion chambers, and which serve also as seals and comprise a sound absorption material containing rubber, or a composite material of ceramic fiber and rubber, or a composite material of a metal and rubber, whereby noise and vibration can be shut off.

The present invention relates to a sound absorption structure-carrying engine comprising a cylinder block provided with cooling means, a cylinder head fixed to the cylinder block and provided with cooling means, pistons moved reciprocatingly in cylinders, combustion chamber members provided in cavities in the cylinder head and constituting the combustion chambers, and sound absorption gaskets provided between outer surfaces of the combustion chamber members and inner surfaces of the cavities and formed out of a material having a heat resistance and a high heat conductivity and capable of minimizing the propagation of vibration.

The combustion chamber members comprise head liners each of which is formed to a unitary structure of a combination of a cylinder lower portion and a cylinder upper portion out of a metal or a heat resisting material, and these head liners are provided in the cavities in the cylinder head via sound absorption gaskets.

Each of the sound absorption gaskets comprises a metal gasket portion positioned on the side of a wall. surface of the relative combustion chamber member and formed out of a metal, and a rubber gasket portion positioned on the side of an outer surface of the metal gasket portion and formed out of heat resisting rubber.

The metal gasket portion comprises a fibrous metal complex, and rubber packed in the metal complex, and is regulated so that the volume of the metal complex becomes larger than that of the rubber.

The rubber gasket portion comprises a porous metal, and rubber packed in the porous metal, and is formed so that the volume of the rubber becomes larger than that of the porous metal. The rubber gasket portion is regulated so that a part thereof contacting the cylinder head is formed out of rubber only.

In another case, each of the sound absorption gaskets comprises a metal formed to a honeycomb structure, and rubber packed in the hollows of the honeycomb structure, and a surface of the honeycomb structure extends at substantially right angles to the outer surface of the relative combustion chamber member.

The metal fiber and metal powder constituting the sound absorption gaskets are materials having a corrosion resistance. The corrosion resistant members constituting the sound-absorption gaskets are formed out of ceramic fiber.

The pistons comprise piston heads and piston skirts fixed to the piston heads, and second sound absorption gaskets are interposed between the piston heads and piston skirts.

Since this engine having sound absorption structures on the outer sides of combustion chambers has the above-described construction, the sound absorption gaskets function as sound absorption layers, and vibration and noise due to the pressure waves occurring in the combustion chambers are shut off, i.e., the sources of sound occurring in the combustion chambers can be isolated, this engine having excellent soundproofing effect and permitting the heat in the combustion chambers to be discharged to the outside through the combustion chamber members, cylinder head and piston skirts owing to the sound absorption gaskets.

The sound absorption gaskets contain a metal of a high heat conductivity, and the combustion chamber members receive heat, which is discharged to the outside through the sound absorption gaskets. Accordingly, the temperature of the sound absorption gaskets does not become high, so that the durability thereof is improved. Moreover, the sound absorption gaskets are provided between various kinds of members, and fulfil the function of seating the clearances between adjacent members.

In this sound absorption structure-carrying engine, the combustion chamber-forming walls and the members supporting these walls are formed separately, and heat is radiated to the clearances between these walls and support members through the metal-containing sound absorption gaskets. Moreover, the sound absorption gaskets also function effectively with respect to the isolation of vibration, and can shut off noise and vibration and radiate heat simultaneously. Since the vibration from the combustion chambers is transmitted molecularly, the propagation thereof can be prevented by interposing laminated structures, in which a solid layer alternates with a gas layer, between object parts. When a vibrating body is formed out of a soft material, for example, rubber, i.e. synthetic rubber, the vibrating particles therein interfere with one another to suppress the propagation of vibratory waves, so that the vibrating body displays a sound absorption effect.

In this sound absorption structure-carrying engine, sound absorption gaskets formed out of a material having a high heat conductivity and capable of minimizing the transmission of vibration are provided between the combustion chamber members and cylinder head. Accordingly, the thermal energy in the combustion chambers is radiated through the sound absorption gaskets, and the pressure waves occurring in the combustion chambers are shut off by the sound absorption gaskets, whereby the occurrence of vibration and noise is prevented. Moreover, since the sound absorption gaskets comprise portions provided on the sides of the combustion chamber members and containing a large amount of metal, and portions provided on the outer sides of the complexes mentioned above, and containing a large amount of rubber, the thermal energy received from the combustion chamber members is radiated immediately to the cylinder head, cylinder block or piston skirts through the sound absorption gaskets. The sound absorption layers comprise heat resistant sound absorption members.

DESCRIPTION OF THE PREFERRED EMBODIMENTS

Figure 1:
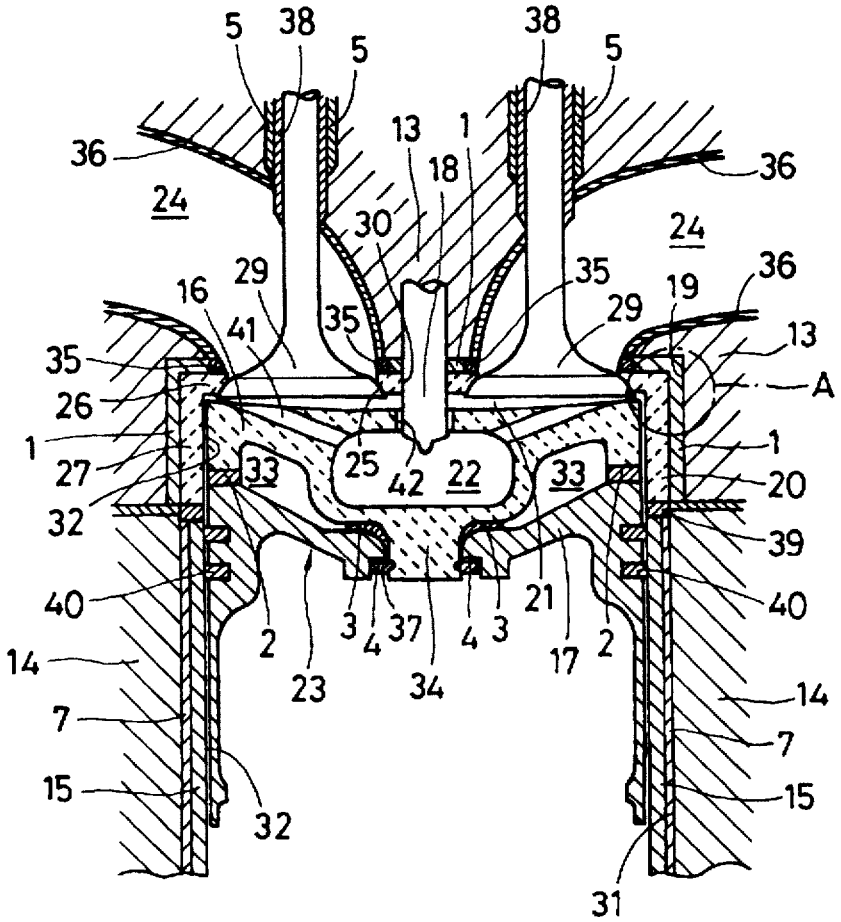
FIG. 1 is a sectional view of an embodiment of the construction of the heat insulating engine having heat insulating layers and sound absorption layers according to the present invention.

The embodiments of the engine having sound absorption structures on the outer sides of combustion chambers according to the present invention will now be described with reference to the drawings. First, an embodiment in which the sound absorption structures in the engine according to the present invention are applied to a heat insulating engine will be described with reference to FIGS. 1 and 2.

This heat insulating engine has a cylinder block 14, a cylinder head 13 fixed to the cylinder block 14 via a gasket 39, suction exhaust ports 24, 24 formed in the cylinder head 13, cylinder liners 15 fitted in bores 31 in the cylinder block 14 via intermediate members 7, head liners 20 provided in cavities 19 of the cylinder head 13 via intermediate members 1, and pistons 23 moved reciprocatingly in cylinders 32 formed in the head liners 20 and cylinders 32 formed in the cylinder liners 15.

The cylinder head 13 is provided with valve guides 38, which are used to reciprocatingly move the suction exhaust valves 29, via intermediate members 5. Port liners 36 are provided on the inner surfaces of the suction exhaust ports 24 formed in the cylinder head 13. The suction exhaust ports 24 are provided therein with the suction exhaust valves 29. Ring-shaped seal members 35 are provided on the sides of the intermediate members 1 which face the suction exhaust ports 24, so as to prevent the intermediate members 1 from being exposed to a gas.

The head liners 20 form combustion chambers 21 constituting primary combustion chambers on the side of the cylinders 32. The head liners 20 comprise liner upper portions 27 constituting upper portions of the cylinders 32, and head lower portions 26 integral with the liner upper portions 27. The head lower portions 26 are provided with ports 25 correspondingly to the suction exhaust ports 24, and through holes 30 for use in inserting fuel injection nozzles 18, which are provided in the cylinder head 13, therethrough so that the fuel injection nozzles project into the combustion chambers 21.

Pistons 23 comprise piston heads 16 positioned on the sides of the combustion chambers 21, and piston skirts 17 fixed to shaft portions 34 of the piston heads 16 by binding rings 37 by a metal flow via intermediate members 2, 3, 4. The piston heads 16 are formed out of a ceramic material having a low heat conductivity and a heat resistance. The piston heads 16 are provided therein with auxiliary chambers (auxiliary combustion chambers) 22. The piston heads 16 are further provided therein with central insert holes 42 so that the fuel injection nozzles 18 project into the auxiliary chambers 22 in positions close to upper dead centers, and a plurality of communication ports 41 allowing communication between the combustion chambers 21 and auxiliary chambers 22. The communication ports 41 extend from the auxiliary chambers 22 toward the combustion chambers 21 and are inclined toward the circumferences of the cylinders. The piston skirts 17 are formed out of a metal. The piston skirts 17 are provided with grooves in which piston rings 40 are fitted. Heat insulating air layers 33 constituting heat insulating layers are formed between the piston heads 16 and piston skirts 17.

This heat insulating engine is provided with members constituting the combustion chambers and comprising a ceramic material, and intermediate members 1–5, 7 comprising gaskets provided on the rear surfaces, i.e. outer surfaces of the combustion chamber members and having the vibration absorption function and heat insulating function, and heat insulating layers and sound absorption layers formed by these intermediate members 1–5, 7 form structures having both the heat insulating function and vibration isolation function.

Concretely speaking, the members constituting the combustion chambers 21 and comprising a ceramic material correspond in this embodiment to the head liners 20, piston heads 16 and cylinder liners 15. Namely, in this heat insulating engine, the intermediate members 1 are provided between the cylinder head 13 and head liners 20, the intermediate members 2–4 between the piston heads 16 and piston skirts 17, the intermediate members 5 between the cylinder head 13 and valve guides 38, and the intermediate members 7 between the cylinder block 14 and cylinder liners 15. The intermediate members 1–5, 7 have various shapes in accordance with the places for the installation thereof, and are formed so that they have heat insulating layers on the high-temperature sides and sound absorption layers on the rear sides of the heat insulating layers, i.e., on the low-temperature sides.

In this heat insulating engine, synthetic rubber having the vibration absorption function con be used as a material for forming the sound absorption layers, so as to satisfy the above-mentioned conditions. Using a rubber material having a heat resistance as the synthetic rubber is preferable. For example, fluororubber, silicone rubber, urethane rubber, chlorosulfonated polyethylene and acrylic rubber can be used, and these sound absorption robber materials may be selected properly in accordance with the places for the installation thereof.

Figure 2:
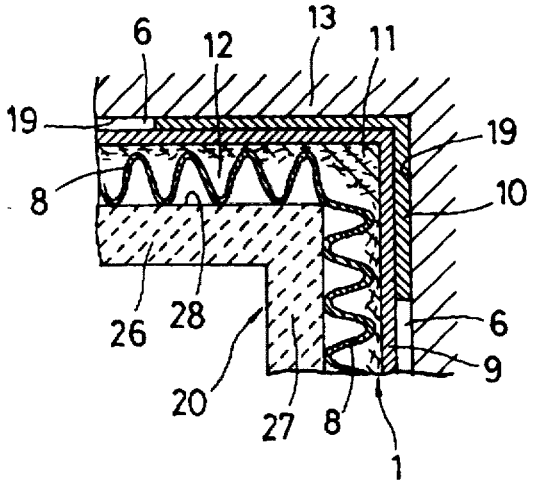
FIG. 2 is an enlarged sectional view of a part a reference letter A of a heat insulating gasket shown in FIG. 1.

Out of the intermediate members, typical intermediate members, i.e. the intermediate members 1 provided between the cylinder head 13 and head liners 20 will now be described with reference to FIG. 2. Each of the head liners 20 comprises an integral structure of a combination of a head lower portion 26 constituting the cylinder upper portion, and a liner upper portion 27 constituting the cylinder upper portion, and is formed out of a ceramic material, such as silicon nitride. The intermediate member 1 comprises a first plate 8 provided on an outer surface 28 of the head liner 20 and having a wavy surface, a second plate 9 formed and provided on the outer side of the first plate 8 with a vacuum layer 12 formed therebetween, and having a flat surface, and a beat resistant sound absorption member 10 provided on the outer side of the second plate 9.

Between the second plate 9 and the inner surface of the cavity 19 in the cylinder head 13, clearances 6 in which the sound absorption member 10 does not exist are provided so as to form non-contacting portions owing to which the second plate 9 and cylinder head 13 are disposed in a non-contacting state. The vacuum layer 12 defined by the first and second plates 8, 9 is filled with ceramic fibers 11 comprising $Si_3N_4$ or SiC. Since the first plate 8 is formed so as to have a wavy surface, a contact area thereof with respect to the outer surface 28 of the head liner 20 is very small. The first and second plates 8, 9 are formed out of a metal, such as SUS having a high heat resistance.

The intermediate members 2–4 provided between the piston heads 16 comprising a ceramic material, such as silicon nitride and piston skirts 17 comprising a metallic material can be formed basically to the same structures as the above-described intermediate members 1. For example, the intermediate members 2 comprise first plates provided on the lower surfaces of the piston heads 16 and having wavy surfaces, second plates provided on the lower surfaces of the first plate with vacuum layers formed therebetween, and having flat surfaces, and heat resistant sound absorption members provided between the lower surfaces of the second plates and the upper surfaces of the piston skirts 17.

In this heat insulating engine, the cylinder liners 15 comprise cylinder members constituting the cylinders 32 and formed out of silicon nitride containing oil adsorptive $Fe_3O_4$ or other kind of metal oxide, and intermediate members 7 provided on the outer sides of the cylinder members and formed out of a composite reinforced sound absorption material comprising heat resistant rubber and a metallic material. The guides provided in the cylinder head 13 and supporting the valves 29 slidably comprise valve guides 38 formed out of silicon nitride containing oil adsorptive $Fe_3O_4$ or other kind of metal oxide, and intermediate members 5 provided on the outer sides of the valve guides 38 and formed out of heat resistant rubber. In another case, intermediate members 7 comprising a sound absorption material formed out of a combination of rubber and metal fiber or ceramic fiber are provided on the outer circumferential portions of the cylinder liners 15.

Figure 3:
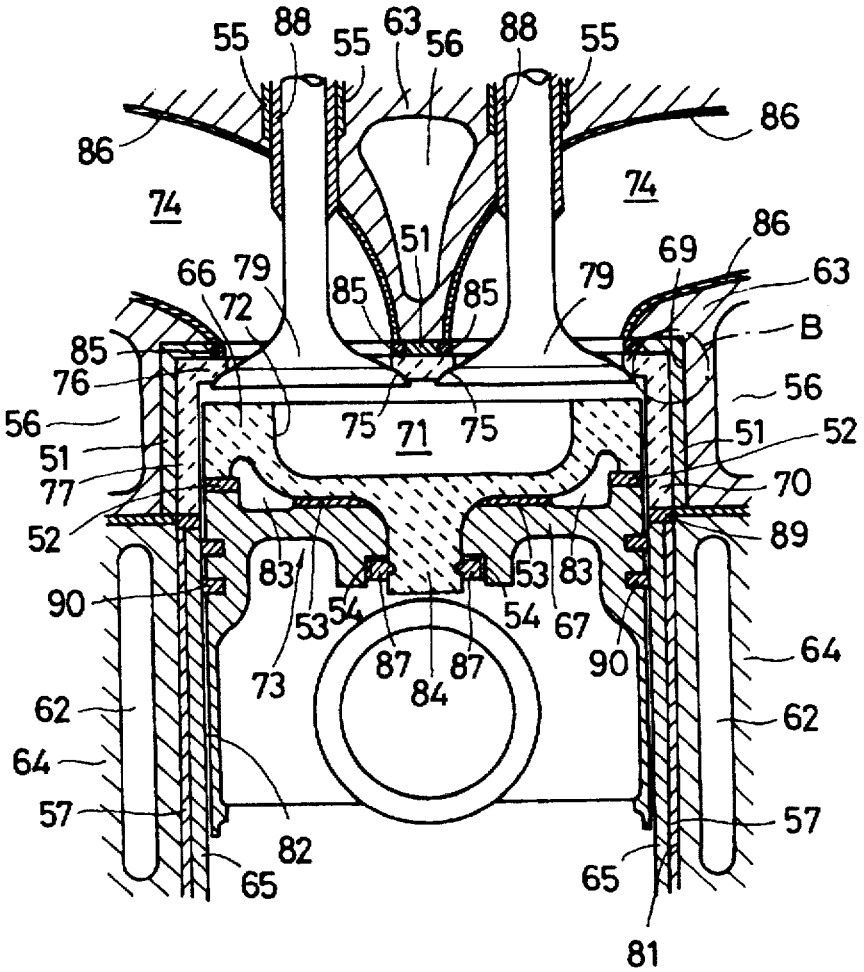
FIG. 3 is a sectional view of another embodiment of the engine having sound absorption structures on the outer sides of combustion chambers according to the present invention.
Figure 4:
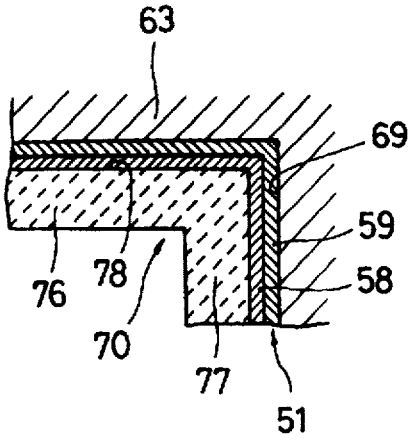
FIG. 4 is an enlarged sectional view of a part of a reference letter B showing a sound absorption gasket incorporated in the engine of FIG. 3.
Figure 5:
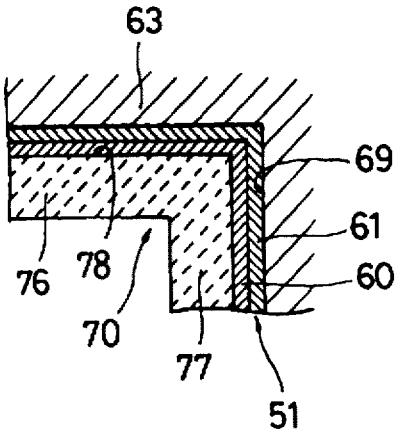
FIG. 5 is an enlarged sectional view of the part of a reference letter B showing another example of a sound absorption gasket incorporated in the engine of FIG. 3.

Another embodiment of the sound absorption structure-carrying engine according to the present invention will now be described with reference to FIGS. 3, 4 and 5.

This engine is a cooling type engine and has a cylinder block 64 provided with water jackets 62 as cooling means, a cylinder head 63 fixed to the cylinder block 64 via a gasket 89 and provided with water jackets 56 as cooling means, suction exhaust ports 74, 74 formed in the cylinder head 63, cylinder liners 65 fitted in bores 81 in the cylinder block 64 via intermediate members 57, head liners 70 provided in cavities 69 in the cylinder head 63 via sound absorption gaskets 51, and pistons 73 moved reciprocatingly in cylinders 82 defined by the head liners 70 and cylinder liners 65. The cylinder head 63 is further provided therein with valve guides 88, which are adapted to slide the suction exhaust valve 79 reciprocatingly, via sound absorption gaskets 55. The suction exhaust ports 74 formed in the cylinder head 63 are provided with port liners 86 on the inner surfaces thereof. Suction exhaust valves 79 are provided in these suction exhaust ports 74. The sound absorption gaskets 51 are provided on the sides thereof which face the suction exhaust ports 74 are provided with ring-shaped seal members 85 so as to prevent the sound absorption gaskets 51 from being exposed to a gas.

The head liners 70 constitute combustion chambers 71 serving as primary chambers formed on the sides of the cylinders 82. The head liners 70 comprise liner upper portions 77 constituting the cylinder upper portions, and head lower portions 76 integral with the liner upper portions 77. The head lower portions 76 are provided with ports 75 correspondingly to the suction exhaust ports 74, and fuel injection nozzles (not shown) are provided in the cylinder head 63.

The pistons 73 comprise piston heads 66 in which cavities 72 constituting parts of the combustion chambers 71 are formed, and piston skirts 67 fixed to shaft portions 84 of the piston heads 66 by binding rings 87 by a metal flow via sound absorption gaskets 52–54. The piston heads 66 are formed out of a heat resistant metal or a ceramic material. The piston skirts 67 are formed out of a metal. The piston skirts 67 are provided with grooves in which piston rings 90 are fitted. Air layers 83 are formed between the piston heads 66 and piston skirts 67.

This sound absorption structure-carrying engine is provided with members constituting the combustion chambers and formed out of a ceramic material, and sound absorption gaskets 51–55, 57 provided on the rear surfaces, i.e. the outer surfaces of the combustion chamber members and comprising gaskets having the vibration absorption function and heat dissipation function, and these sound absorption gaskets 51–55, 57 form sound absorption layers, whereby structures having the vibration isolation function and sound-proofing function are formed.

Concretely speaking, the members constituting the combustion chambers 71 and formed out of a heat resistant metal or a ceramic material correspond to the head liners 70, piston heads 66 and cylinder liners 65 in this embodiment. Namely, in this engine, the sound absorption gaskets 51 are provided between the cylinder head 66 and head liners 70, the sound absorption gaskets 52–54 between the piston heads 66 and piston skirts 67, the sound absorption gaskets 55 between the cylinder head 63 and valve guides 88, and the sound absorption gaskets 57 between the cylinder block 64 and cylinder liners 65. The sound absorption gaskets 51–55, 57 have various shapes in accordance with the places for the installation thereof. Gaskets containing a metal as a main component are provided on the high-temperature sides, and sound absorption members containing rubber as a main component on the rear surfaces of the gaskets of the metal material, i.e., on the low-temperature sides.

Since this sound absorption structure-carrying engine satisfies the above-mentioned conditions, the material used for forming the sound absorption layers may be the same as that used in the first embodiment.

Out of these sound absorption gaskets, the sound absorption gasket 51 provided between the cylinder head 63 and a head liner 70 will now be described as a typical sound absorption gasket with reference to FIG. 4. The head liner 70 is formed out of a material, such as a metal or silicon nitride to an integral structure of a combination of the head lower portion 76 constituting the cylinder upper portion, and the liner upper portion 77 constituting the cylinder upper portion. The sound absorption gasket 51 comprises a complex 58 provided on the outer surface 78 of the head liner 70 and formed out of rubber and a metal, and a heat resistant rubber member 59 provided on the outer side of the complex 58. The complex 58 is formed at the portion thereof which contacts the combustion chamber 71 out of a material containing as a main component a metal, such as SUS having a high heat resistance.

The sound absorption gaskets 52–54 provided between the piston heads 66 formed out of a material, such as a heat resistant metal or silicon nitride and piston skirts 67 formed out of a metallic material can basically be formed to the same structures as the above-mentioned sound absorption gaskets 51. For example, the sound absorption gaskets 52 comprise complexes 58 provided on the lower surfaces of the piston heads 66, and heat resistant rubber members 59 provided between the lower surfaces of the complexes 58 and the upper surfaces of the piston skirts 67.

The cylinder liners 65 comprise metal liners constituting the cylinders 82 or cylinder members formed out of silicon nitride containing oil adsorptive $Fe_3O_4$, and sound absorption gaskets 57 formed out of a composite reinforced sound absorption material of a combination of heat resistant rubber and a metallic material and provided on the outer sides of the cylinder members. The guides slidably supporting the suction exhaust valves 79 provided in the cylinder head 63 comprise valve guides 88 formed out of silicon nitride containing oil adsorption $F_3O_4$, or a metallic material, such as a casting, and sound absorption gaskets 55 provided on the outer sides of the valve guides 88 and formed out of heat resistant rubber.

The sound absorption gaskets will now be described with reference to FIG. 5. Each of the sound absorption gaskets 51 comprises a complex 60 formed out of a porous metal, and rubber packed in the porous metal so that the content of the metal is higher than that of the rubber, and a complex 61 formed out of a porous metal, and rubber packed in the porous metal so that the content of the rubber is higher than that of the porous metal. The complex 60 in the sound absorption gasket 51 is provided in contact with the outer surface 78 of the head liner 70, and the complex 61 on the outer surface of the complex 60.

The sound absorption gaskets can also be formed out of, for example, a metal of a honeycomb structure, and synthetic rubber packed in the hollows of the honeycomb structures. When the sound absorption gaskets are formed to honeycomb structures, the honeycomb surfaces are formed so as to extend at substantially right angles to the outer surfaces of the combustion chamber members, and the portions of the honeycomb structures which contact the cylinder block 64 or cylinder head 63 comprise rubber alone.

What is claimed is:

1. A sound absorption structure-carrying engine comprising a cylinder head fixed to a cylinder block, cylinder liners provided in bores in said cylinder block and forming cylinders, pistons moved reciprocatingly in said cylinders, and combustion chamber members forming combustion chambers provided in cavities in said cylinder head, said pistons comprising piston heads and piston skirts fixed to said piston heads, intermediate members being provided between said combustion chamber members and said cylinder head, and between said piston heads and said piston skirts, wherein said intermediate members are adapted to absorb the vibration occurring in said combustion chambers and have a sound absorption layer capable of minimizing the transmission of vibration.

2. A sound absorption structure-carrying engine according to claim 1, wherein said combustion chamber members comprise integral structures of combinations of head lower portions and head liners.

3. A sound absorption structure-carrying engine comprising a cylinder block in which cylinders are provided, a cylinder head fixed to said cylinder block, pistons moved reciprocatingly in said cylinders, combustion chamber members forming combustion chambers provided in cavities formed in said cylinder head, and first intermediate members provided between the inner surfaces of said cavities and the outer surfaces of said combustion chamber members, each of said first intermediate members comprising a heat insulating layer of a low heat conductivity and a sound absorption layer provided on the outer side of said heat insulating layer and capable of minimizing the transmission of vibration, said combustion chambers being formed to heat insulating structures by said heat insulating layers.

4. A sound absorption structure-carrying engine according to claim 3, wherein said combustion chamber members comprise head liners formed as integral structures of combinations of cylinder head lower portions and cylinder upper portions out of a ceramic material, including silicon nitride, said combustion chamber members being supported on said cylinder head via said first intermediate members.

5. A sound absorption structure-carrying engine according to claim 2, wherein said first intermediate members comprise first plates provided on the outer sides of said head liners and having wavy surfaces, second plates provided on the outer sides of said first plates with vacuum layers formed therebetween, and having flat surfaces, ceramic fibers provided between said first and second plates, and heat resistant sound absorption members provided on the outer sides of said second plates so that the outer surfaces of said second plates are in non-contacting state with respect to the inner surfaces of said cavities.

6. A sound absorption structure-carrying engine according to claim 5, wherein said pistons comprise piston heads formed out of a ceramic material, and piston skirts fixed to said piston heads and formed out of a metallic material, second intermediate members being provided between said piston heads and said piston skirts, each of said second intermediate members comprising a heat insulating layer of a low heat conductivity and a sound absorption layer provided on the outer side of said heat insulating layer and capable of minimizing the transmission of vibration.

7. A sound absorption structure-carrying engine according to claim 6, wherein said second intermediate members comprise first plates provided on the lower surfaces of said piston heads and having wavy surfaces, second plates provided on the lower surfaces of said first plates with vacuum layers formed therebetween, and having flat surfaces, and heat resistant sound absorption members provided between the lower surfaces of said second plates and the upper surfaces of said piston skirts.

8. A sound absorption structure-carrying engine according to claim B, wherein said cylinders comprise cylinder liners fitted in bores formed in said cylinder block, said cylinder liners comprising cylinder members forming said cylinder surfaces and formed out of silicon nitride containing a metal oxide of oil adsorptive $Fe_3O_4$, and second intermediate members provided on the outer sides of said cylinder members and formed out of sound absorption materials of combinations of heat resistant rubber and a metallic material.

9. A sound absorption structure-carrying engine according to claim 3, wherein valve guides slidably supporting suction exhaust valves provided in said cylinder head are formed out of silicon nitride containing a metal oxide of oil adsorptive $Fe_3O_4$, second intermediate members formed out of heat resistant rubber being provided on the outer sides of said valve guides.

10. A sound absorption structure-carrying engine according to claim 3, wherein said cylinders comprise cylinder liners fitted in bores formed in said cylinder block, second intermediate members comprising a composite sound absorption material of a combination of either metal fiber or ceramic fiber and rubber being provided on the outer circumferential portions of said cylinder liners.

11. A sound absorption structure-carrying engine comprising a cylinder block provided with cooling means, a cylinder head fixed to said cylinder block and provided with cooling means, pistons moved reciprocatingly in said cylinders, combustion chamber members forming combustion chambers provided in cavities in said cylinder head, and first sound absorption gaskets provided between the outer surfaces of said combustion chamber members and the inner surfaces of said cavities and formed out of a material having a heat resistance and a high heat conductivity and capable of minimizing the transmission of vibration, wherein first sound absorption gaskets are adapted to absorb the vibration occurring in said combustion chambers and have a sound absorption layer capable of minimizing the transmission of vibration.

12. A sound absorption structure-carrying engine according to claim 11, wherein said combustion chamber members are head liners formed out of heat resistant material as integral structures of combinations of cylinder head lower portions and liner upper portions, said head liners being provided in said cavities in said cylinder head, said sound absorption gaskets being interposed between said head liners and said cavities in said cylinder head.

13. A sound absorption structure-carrying engine according to claim 11, wherein said first sound absorption gaskets comprise metal gasket portions positioned on the sides of wall surfaces of said combustion chamber members and formed out of a metal, and rubber gasket portions positioned on outer surfaces of said metal gasket portions and formed out of heat resistant rubber.

14. A sound absorption structure-carrying engine according to claim 13, wherein said metal gasket portions comprise fibrous metal complexes and rubber mixed in said metal complexes, the content of said metal complexes being regulated to a level higher than that of said rubber.

15. A sound absorption structure-carrying engine according to claim 14, wherein said rubber gasket portions comprise a porous metal and rubber packed in said porous metal, and have structures in which the volume of said rubber is larger than that of said porous metal, the parts of said rubber gasket portions which contact said cylinder head comprising said rubber alone.

16. A sound absorption structure-carrying engine according to claim 11, wherein said first sound absorption gaskets comprise honeycomb structures made of a metal, and a rubber being packed in hollows of said honeycomb structures, the surface of said honeycomb structures extending at substantially right angles to the outer surfaces of said combustion chamber members.

17. A sound absorption structure-carrying engine according to claim 11, wherein said first sound absorption gaskets are formed out of a material comprising corrosion resistant metal fiber and metal powder.

18. A sound absorption structure-carrying engine according to claim 11, wherein said first sound absorption gaskets are formed out of a material comprising corrosion resistant ceramic fiber.

19. A sound absorption structure-carrying engine according to claim 11, wherein said pistons comprise piston heads formed out of a ceramic material, and piston skirts fixed to said piston heads and formed out of a metallic material, second sound absorption gaskets being provided between said piston heads and said piston skirts, said second sound absorption gaskets comprising heat insulating layers of a low heat conductivity, and sound absorption layers provided on the outer sides of said heat insulating layers and capable of minimizing the transmission of vibration.

* * * * *